US009951646B2

(12) United States Patent
Byrd et al.

(10) Patent No.: US 9,951,646 B2
(45) Date of Patent: Apr. 24, 2018

(54) GAS TURBINE ON-LINE WATER WASH SYSTEM AND METHOD

(71) Applicant: General Electric Company, Schenectady, NY (US)

(72) Inventors: Doug Scott Byrd, Greenville, SC (US); Gilbert Otto Kraemer, Greenville, SC (US); Hua Zhang, Greenville, SC (US); Jianmin Zhang, Greenville, SC (US); Valery Ivanovich Ponyavin, Greenville, SC (US)

(73) Assignee: General Electric Company, Schenectady, NY (US)

( * ) Notice: Subject to any disclaimer, the term of this patent is extended or adjusted under 35 U.S.C. 154(b) by 108 days.

(21) Appl. No.: 13/932,467

(22) Filed: Jul. 1, 2013

(65) Prior Publication Data

US 2015/0000693 A1 Jan. 1, 2015

(51) Int. Cl.
*F01D 25/00* (2006.01)
*B08B 7/00* (2006.01)

(52) U.S. Cl.
CPC ..... *F01D 25/002* (2013.01); *B08B 7/00* (2013.01); *F05D 2270/172* (2013.01)

(58) Field of Classification Search
None
See application file for complete search history.

(56) References Cited

U.S. PATENT DOCUMENTS 2,874,537 A 2/1959 Scarborough et al.
4,196,020 A 4/1980 Hornak et al.
4,808,235 A * 2/1989 Woodson ..... C11D 1/835 134/22.19
5,011,540 A 4/1991 McDermott
6,553,768 B1 * 4/2003 Trewin et al. ..... 60/772
6,630,198 B2 10/2003 Ackerman et al.
7,428,906 B2 9/2008 Asplund et al.
7,520,137 B2 4/2009 Hoffmann et al.
7,670,440 B2 3/2010 Asplund et al.
7,938,910 B2 5/2011 Asplund et al.
(Continued)

FOREIGN PATENT DOCUMENTS

CN 1908383 2/2007
EP 1 570 158 9/2005
(Continued)

OTHER PUBLICATIONS www.virginia.edu/bohr/mse209/chapter19.htm.*

*Primary Examiner* — Nicole Blan
*Assistant Examiner* — Pradhuman Parihar
(74) *Attorney, Agent, or Firm* — Nixon & Vanderhye P.C.

(57) ABSTRACT

An on-line wash system for a compressor including: a nozzle including a flow passage for wash liquid, wherein the flow passage is configured to be coupled to a source of a wash liquid and includes a discharge outlet arranged to project the wash liquid into a stream of working fluid for the turbomachine; an electrode proximate to the flow passage of the nozzle, wherein the electrode is configured to form an electrical field sufficient to charge the wash liquid flowing through the passage and the charge applied to the wash liquid is of a first polarity, and a surface of the compressor charged with the first polarity, wherein the surface is exposed to the stream of working fluid and downstream of the nozzle.

9 Claims, 6 Drawing Sheets

(56) References Cited

U.S. PATENT DOCUMENTS

| | | | | |
|---|---|---|---|---|
| 8,028,936 | B2 | 10/2011 | McDermott | |
| 2003/0015594 | A1* | 1/2003 | Kelly | 239/3 |
| 2004/0016445 | A1* | 1/2004 | Koch | C11D 3/02 134/7 |
| 2004/0098989 | A1 | 5/2004 | Mansour et al. | |
| 2005/0011198 | A1* | 1/2005 | Ritland | 60/775 |
| 2006/0118132 | A1* | 6/2006 | Bergman | B08B 3/02 134/1 |
| 2006/0243308 | A1 | 11/2006 | Asplund et al. | |
| 2007/0000528 | A1* | 1/2007 | Asplund | B08B 3/02 134/166 R |
| 2007/0012342 | A1* | 1/2007 | Stansilaw | B08B 9/0321 134/169 A |
| 2007/0028947 | A1 | 2/2007 | Erickson et al. | |
| 2008/0173327 | A1* | 7/2008 | Miyagi | B05B 5/03 134/1.3 |
| 2009/0065026 | A1* | 3/2009 | Kiehlbauch | H01J 37/3233 134/1.2 |
| 2009/0114246 | A1* | 5/2009 | Sinha | B08B 3/10 134/1.3 |
| 2010/0116292 | A1* | 5/2010 | Wagner | B08B 3/00 134/18 |
| 2010/0132745 | A1 | 6/2010 | Hjerpe et al. | |
| 2010/0135790 | A1* | 6/2010 | Pal | F03D 1/0675 416/1 |
| 2010/0206966 | A1 | 8/2010 | McDermott | |
| 2010/0229953 | A1* | 9/2010 | Stuart | B01F 3/0865 137/1 |

FOREIGN PATENT DOCUMENTS

| | | | |
|---|---|---|---|
| EP | 1 663 505 | 6/2006 | |
| EP | 1 749 976 | 2/2007 | |
| JP | 2000-274206 | 10/2000 | |
| WO | 2004/055334 | 7/2004 | |
| WO | 2005/028119 | 3/2005 | |
| WO | 2008/045396 | 4/2008 | |
| WO | WO2012171985 | * 12/2012 | A62C 3/14 |

* cited by examiner

GAS TURBINE ON-LINE WATER WASH SYSTEM AND METHOD

BACKGROUND OF THE INVENTION

The invention relates to an on-line wash system for a compressor in a gas turbine or other turbomachine.

Spraying water into the inlet of a compressor of a gas turbine is a commonly used technique to wash the compressor and remove dirt and other material from the surfaces of the compressor, and particularly from the surfaces of the blades of the compressor. The wash systems are on-line in the sense that they inject water into the compressor while the gas turbine is operating.

Conventional on-line wash systems inject water into the air flow passing through a bell mouth casing mounted to the inlet of a compressor. The bell mouth inlet casing has interior and exterior walls that define an air passage (also referred to as an air plenum) leading to the inlet of the compressor.

Nozzles are typically mounted on the walls of the bell mouth casing. The nozzles spray water into the air flowing through the bell mouth casing. The spray forms water droplets that enter the compressor. Droplets migrate towards streams of relatively low velocity of the air such as streams moving along the walls of the bell mouth casing. Accordingly, the density of water droplets increases in streams of low velocity air.

The droplets have mass and impact forcibly against the rotating blades of the compressor, especially the first stage blades that are nearest the inlet. The impacts of the droplets can pit and erode the blades. The pitting and erosion may be greatest at the roots of the blades which are exposed to the high density of droplets in the slower streams moving along the walls of the bell mouth casing. The droplets impacting the rotor blades may over time cause in pitting and erosion of the blades, particularly at the roots of the blades.

BRIEF DESCRIPTION OF THE INVENTION

There is a long felt need for a compressor wash system that reduces first stage rotor blade root pitting and erosion. The wash system should also provide effective cleaning of the compressor, preferably as effective as conventional wash systems.

A novel wash system has been invented that applies electric charges to the wash water droplets, the walls of the bell mouth casing and the blades of the compressor. The wash system applies electrohydrodynamic (EHD) atomization to form the charged wash water droplets. The polarity of the charge applied to the droplets is the same as the polarity applied to the casing and blades. Because like electrical charges repel, the charged droplets are repelled by the charged surfaces of walls of the bell mouth casing and the blades of the compressor.

Repelling charged droplets away from the walls on the bell mouth casing diminishes the density of droplets in the slower moving airflow along the walls. The density of droplets is reduced in the slow moving air streams near the charged surfaces and, thus, fewer droplets impact the roots of the blades of the first stage of the compressor.

The electronically charged droplets and blades form a system that automatically directs droplets towards dirty surfaces of the blades and away from clean blade surfaces. The surface electrical charges, e.g., eddy currents, on the blades are strongest on clean surfaces of the blades due to the exposed metal of a clean surface. The surface electrical charges are diminished on dirty surfaces of the blades because the coating of dirt and other materials tends to be less conductive. The diminished surface charges on the dirty surface are less likely to repel wash droplets than is a clean surface. Thus, water droplets tend to impact dirty surfaces more so than clean blade surfaces. As the dirty surfaces are cleaned by the water droplets, the electrical charges increase and the newly cleaned surfaces repel the wash droplets.

The conductivity of the surfaces of the bell mouth casing and compressor is monitored to sense when the blade surfaces are cleaned. A higher conductivity indicates a cleaned surface because dirty surfaces resist the surface currents, e.g., eddy currents. If the conductivity of the compressor, e.g., conductivity of rotor blades, increases above a threshold resistance (or impedance or other electrical characteristic) level, the wash system may start injecting wash water (or other wash liquid) through nozzles and into the bell mouth casing. In response to the resistance (or impedance or other electrical characteristic) falling below a second threshold (which may be lower than the first threshold), the wash system may be turned off.

An on-line wash system has been invented for a compressor of a gas turbine or other turbomachine including: a nozzle including a flow passage for wash liquid, wherein the flow passage is configured to be coupled to a source of a wash liquid and includes a discharge outlet arranged to project the wash liquid into a stream of working fluid for the turbomachine; an electrode proximate to the flow passage of the nozzle, wherein the electrode is configured to form an electrical field sufficient to charge the wash liquid flowing through the passage and the charge applied to the wash liquid is of a first polarity, and a surface of the compressor charged with the first polarity, wherein the surface is exposed to the stream of working fluid and downstream of the nozzle.

An on-line wash system has been invented for a compressor of a gas turbine comprising: an array of nozzles arranged in a bell mouth casing of the gas turbine, wherein each nozzle includes a was liquid passage and an electrode, wherein the wash liquid passage includes an inlet coupled to a source of the wash liquid and an outlet adjacent a wall of the bell mouth casing and positioned to project the wash liquid into a stream of working fluid moving through the bell mouth casing, and the least one electrode is proximate to the wash liquid passage; a source of electrical energy coupled to the at least one electrode to form an electrical field sufficient, and a row of blades in the compressor electrically charged with the same polarity as the polarity applied to the wash liquid.

A method has been invented to apply a wash liquid to a turbomachine comprising: injecting at least one stream of charged wash liquid into a flow of working fluid moving through the turbomachine, wherein the charged wash liquid has an electrical charge of a first polarity, and applying an electrical charge of the first polarity to a surface of the turbomachine while the charged wash liquid is being injected, wherein the surface is exposed to the working fluid and downstream of the injection.

DETAILED DESCRIPTION OF THE INVENTION

Figure 1:
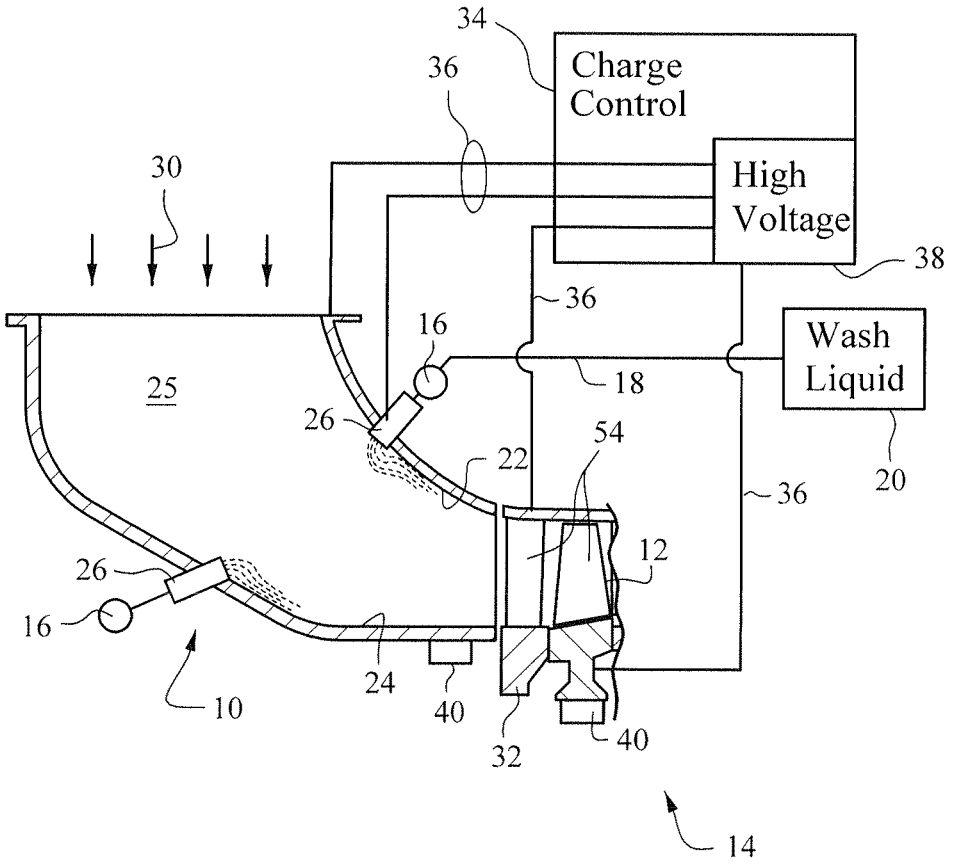
FIG. 1 is a schematic diagram of a wash system that injects water into a compressor of an operating gas turbine, wherein only the upper half of the gas turbine is shown and is shown in cross-section.

FIG. 1 is a schematic diagram of a wash system 10 that injects water into a compressor 12 of a gas turbine 14. The wash system is on-line such that it that it injects wash water during operation of the gas turbine while the compressor is drawing in air as the working fluid. The water wash system 10 includes conduits, such as an annular conduit 16 and supply conduits 18 that form passages delivering wash liquid, e.g., water, from a source 20 to the annular conduit.

The annular conduit may be mounted to an interior wall(s) 22, 24 of a bell mouth casing 25. The casing is coupled to the outer circumference of an inlet to the compressor. The annular conduit delivers water to an annular array of nozzles 26. The nozzles extend through the wall(s) of the bell mouth casing and are arranged to spray water into the air flowing through the bell mouth casing. The nozzles may also or alternatively be positioned on the struts 28 of extending between the interior walls 22, 24 of the bell mouth casing.

The wash liquid injected through the nozzles enters the air flowing through the bell mouth casing and to the inlet of the compressor. The wash liquid flows over the surfaces of the bell mouth casing exposed to the air flow 30, such as the radially outer wall 22 and radially inner interior wall 24. The wash liquid flowing enters the inlet to the compressor and washes the surfaces in the compressor exposed to the air flow.

The exposed surfaces of the compressor include the blades of the rotor and stator. The first stage row 32 of blades are the first compressor surfaces exposed to the wash liquid and receive most of the wash droplets projected from the nozzles.

A charge control system 34 applies electrical charges to the surfaces of the bell mouth casing and to the compressor 12. Specifically, the electrical charge is applied to form surface charges on the interior walls 22, of the bell mouth housing, especially the surfaces downstream of the wash nozzles 26. Similarly, the electrical charge is applied to form surface charges on the first stage 32 of the compressor and particularly on the stator and rotor blades. Wires 36 and other electrical connectors couple the charge control system to the walls of the bell mouth casing and the compressor.

The charge control system 34 may include or be associated with a high voltage source 38 for the voltage applied to the surfaces of the bell mouth casing, compressor and water droplets. The high voltage source may supply a voltage in a range of 2,000 to 20,000 volts. The voltage level and current generated by the voltage source will depend on design considerations such as the amount of surface charge to be applied to the exposed surfaces of the bell mouth casing, compressor and the water droplets.

The charge control system and high voltage source may apply a direct current (DC) to the casing walls, compressor and water droplets. Alternatively, the charge control system may apply an alternating current (AC) to these surfaces. The charge control system applies voltage of the same polarity to all of the surfaces to achieve the desired repelling of water droplets from the surfaces.

The charge control system 34 may include sensors 40, e.g., current, voltage or resistive sensors that monitor the electrical charges on the walls of the bell mouth casing and rotor blades of the compressor. These sensors may indirectly measure the electrical charges by sensing the amount of current flowing from the high voltage source to the bell mouth casing and the compressor. The charge control system may use data from the sensors to determine whether the surfaces of the bell mouth casing and compressor are dirty and need to receive wash water and whether these surfaces have been cleaned by the wash water.

The selection of surfaces to which the electrical charges are to be applied will depend on factors such as the surfaces for which there is a desire to control the impacts of water droplets and the extent to which these surfaces are conductively connected to other surfaces in the bell mouth casing and compressor. For example, electrical current may be directly applied to the radially interior wall 24 of the bell mouth housing and the first row of rotor blades in the compressor.

Figure 2:
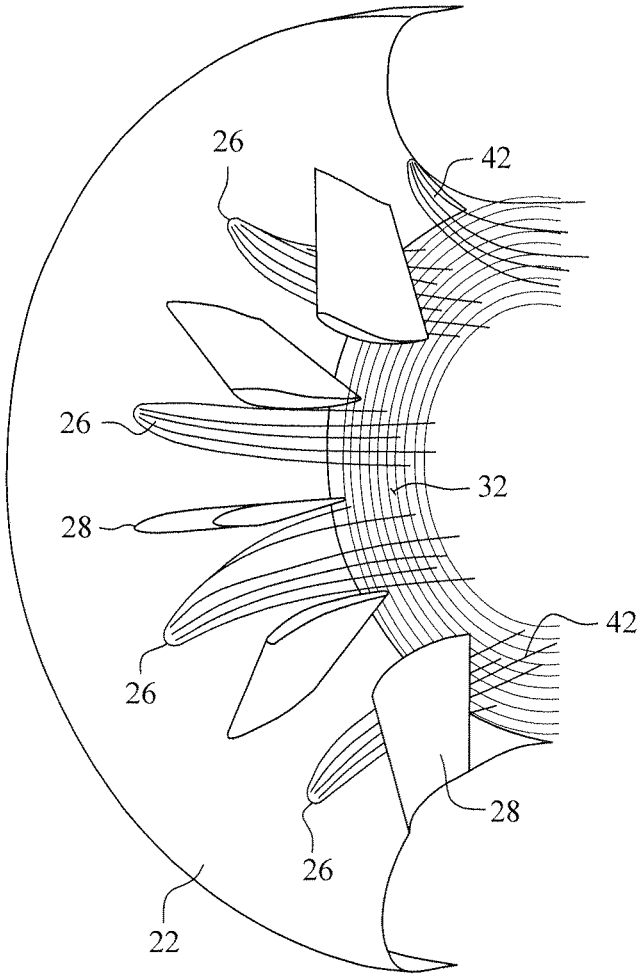
FIG. 2 is a perspective view of a cut-away portion of a bell mouth casing, wherein wash nozzles inject water along the interior wall of the casing.
Figure 3:
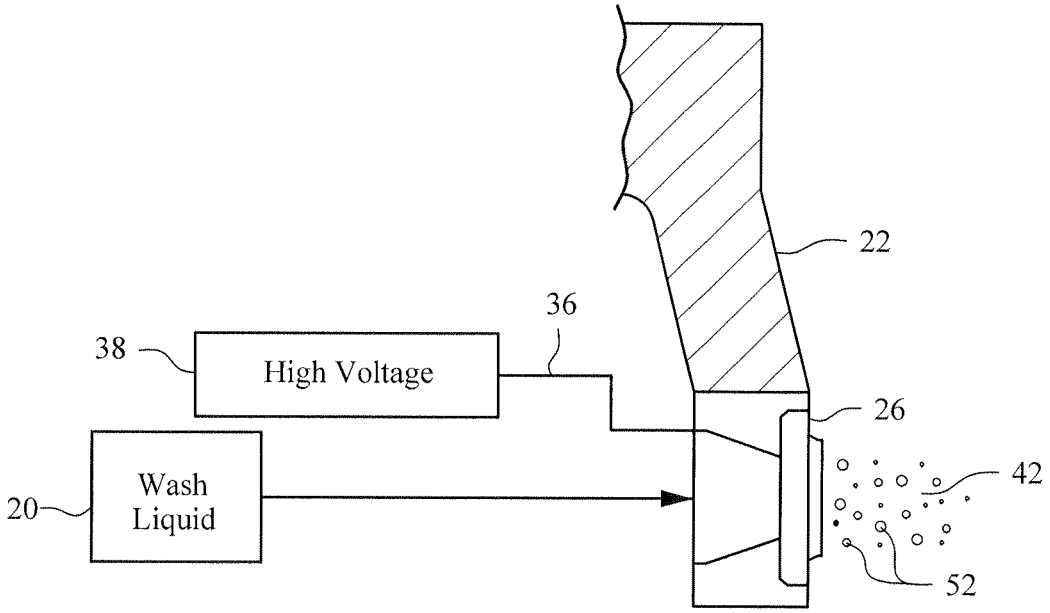
FIG. 3 is a cross-sectional diagram of a nozzle mounted in a wall of the bell mouth casing.

FIG. 2 is a perspective view of a cut-away portion of a bell mouth casing 25, wherein wash nozzles 26 inject water along the interior wall 22 of the casing. FIG. 3 shown in cross-section at nozzle 26 mounted in a wall of the bell mouth casing. The wash nozzles 26 may be arranged in symmetrically around the wall(s) of the bell mouth casing. For example, a wash nozzle may be positioned between adjacent struts 28 on the outer wall 22 of the bell mouth casing. The wash nozzles may also be arranged in a symmetrical annular pattern around the inside wall of the bell mouth casing and on the struts. Further, wash nozzles may be arranged in both the inlet casing for the fan blades of a compressor in an aircraft gas turbine and the walls of the inlet housing leading to the first row of compressor blades for the same aircraft gas turbine.

Each wash nozzle projects a plume 42 water droplets into the air flow 30 moving through the bell mouth casing. The plumes start as concentrated steams injected from the nozzles and become increasingly distributed in the air flow as they move downstream of the nozzles. The distribution of the plume into the air flow tends to increase in a radially inward direction, as is shown by the lines forming the plumes 42. The lines are close together to indicate a high density of water droplets and become increasingly further apart in a radially inward direction to indicate a gradual reduction in droplet density.

The plumes shown in FIG. 2 are indicative of plumes 42 formed with electrical charges applied to the water droplets and the outer wall 22 of the bell mouth casing. The density of the droplets near the outer wall 22 is lessened by the application of electrical charges of the same polarity to the water droplets and the outer wall.

As the plumes 42 reach the first row 32 of blades, the water droplets in the plumes impact the moving blades of the rotor and the stationary blades of the stator. Because the density of the water droplets near the walls of the bell mouth casing has been reduced by the repulsive forces of the same polarity electrical charges, the water droplets are less likely to pit and erode the blades, e.g., the root of the stator blades, near the walls.

Figure 4:
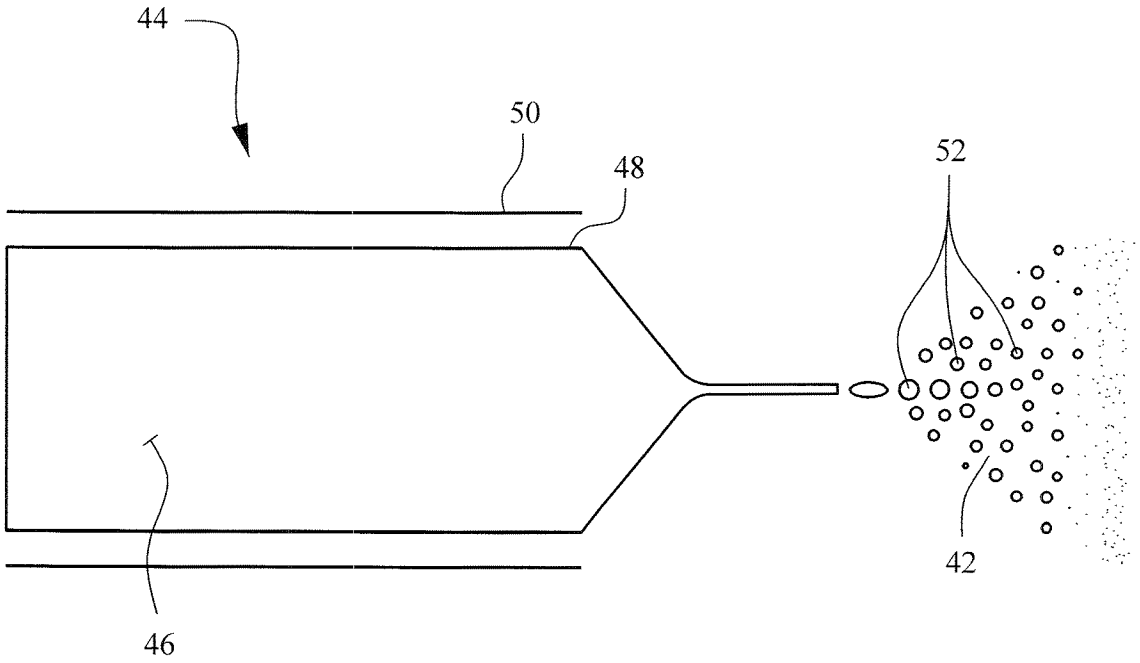
FIG. 4 is a cross-sectional diagram of an Electrohydrodynamic (EHD) nozzle for spraying charged water droplets into the compressor.

FIG. 4 is a cross-sectional diagram of an EHD nozzle 44 for spraying electrically charged water droplets. These nozzles 44 may be used as the nozzles 26 mounted to the bell mouth casing shown in FIGS. 1 and 2. The nozzles 44 apply an electrical charge to the wash water as the water is injected into the air flow entering the compressor.

An EHD nozzle 44 is an example of a nozzle that may be used to apply an electrical charge to the water injected into air flow. The EHD nozzle includes a capillary tube 46 and electrodes 48 50. The electrodes may be formed as concentric tubes. The inner electrode 48 forms the capillary tube 46. The outer electrode is separated from the inner electrode by a cylindrical gap. Electrical energy is applied to the electrodes to form a high voltage across the gap and create an electrical field surrounding the electrodes and capillary tube. The electrical field is applied to the wash water as the water flows through the capillary tube.

EHD nozzles are used for electrohydrodynamic atomization of the wash water. EHD atomization generates uniformly sized droplets that are electrically charged. Applying an electrical charge to the stream shapes the stream into a cone (so-called Taylor cone) at the discharge end of the capillary tube and a jet of liquid droplets is projected from the tip of the cone.

Figure 5:
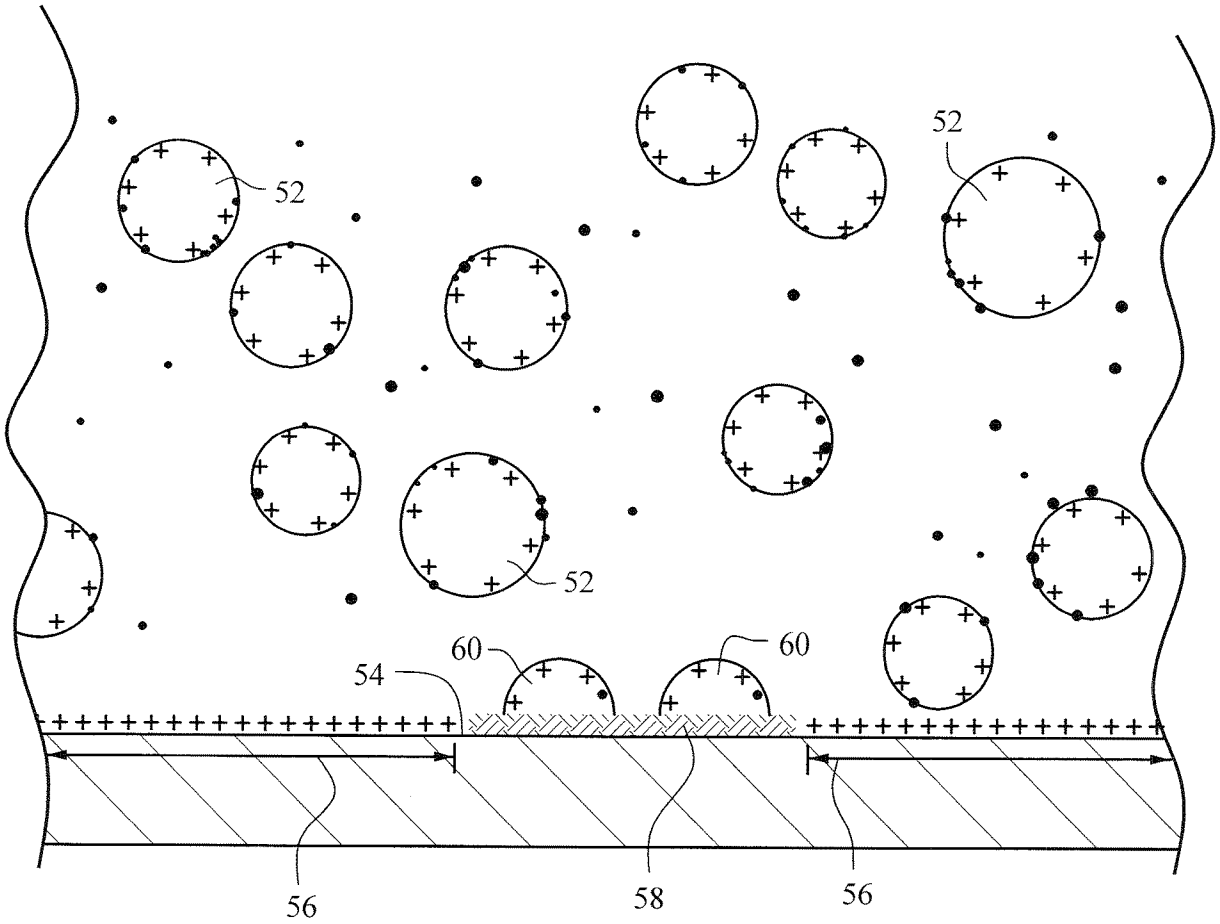
FIG. 5 is a schematic diagram of charged water droplets sprayed flowing over the charged surfaces of a compressor.

FIG. 5 is a schematic diagram of charged water droplets 52 flowing over a charged surface 54 of a compressor. The electrical charges on the droplets are indicated by the positive plus symbols (+) near the surfaces of the droplets. The clean portions 56 of the surface have exposed metal that is conductive and supports a surface electrical charge that is also indicated by positive plus symbols. The surface electrical charge on the clean portions 56 repels the charged water droplets because the droplets and clean portions have the same charge polarity. The repulsive force need not entirely prevent droplets from impacting the charged surfaces. It is sufficient for the repulsive forces to reduce the impacts on the clean surfaces as compared to the dirty surfaces.

Dirty portions 58 of the surface 54 are covered by dirt and other materials that are general insulating and do not support an electrical charge. The water droplets 60 impact and clean away the dirt from the dirty portions. The water droplets 60 are not repelled because the dirty portions do not have an electrical charge, or have a reduced charge as compared to the cleaned surfaces.

Figure 6:
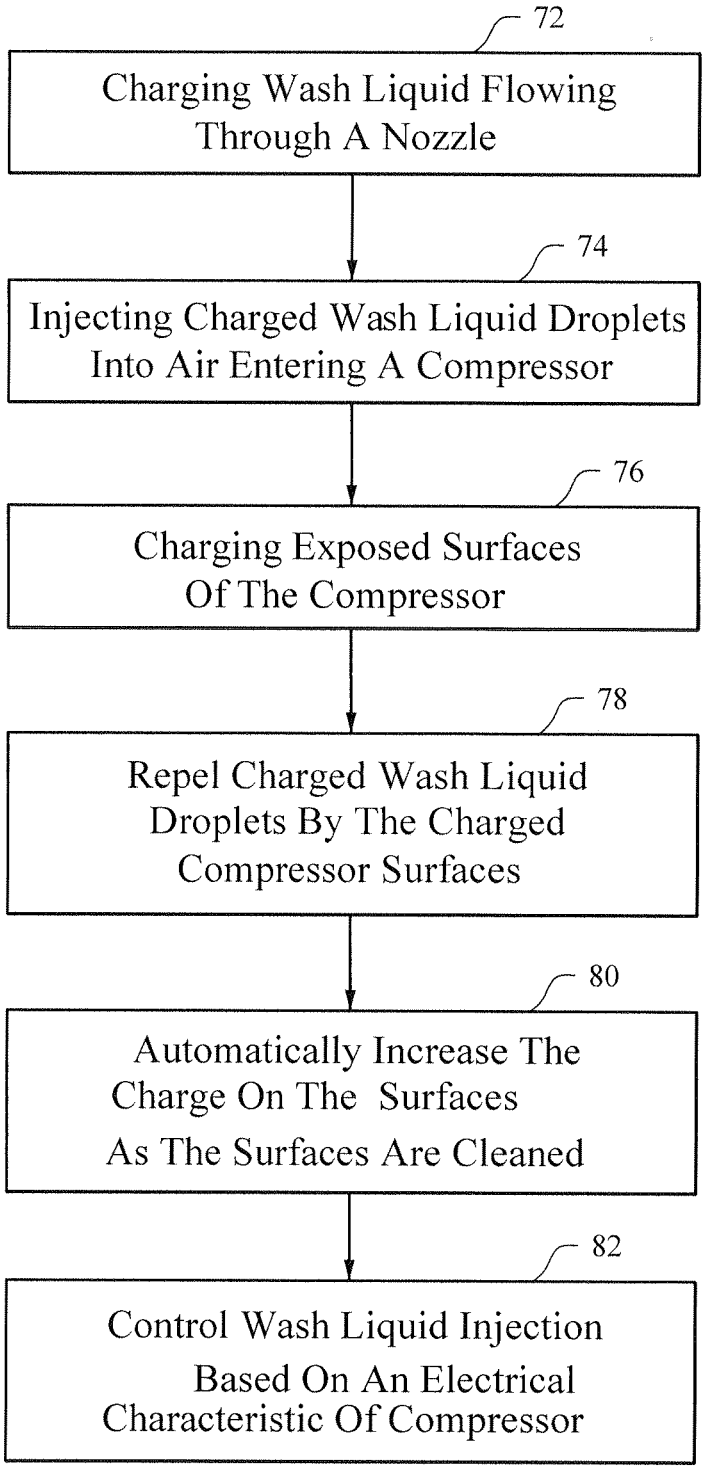
FIG. 6 is a flow chart of an on-line compressor wash system that applies electrical charges to wash droplets and the surfaces of the compressor exposed to the droplets.

FIG. 6 is a flow chart of an on-line compressor wash method 70 that applies electrical charges to wash droplets and the surfaces of the compressor exposed to the droplets.

The method includes charging 72 wash liquid as the liquid flows through nozzles. The charging of the wash liquid may be to apply an electrical charge of a first polarity, such as a positive or negative polarity, to the liquid as it is injected from a nozzle. The electrical charge is applied to the wash liquid by forming a high voltage electrical field to the liquid flow moving through the nozzle.

The wash liquid, such as water, is injected 72 as streams of charged wash liquid droplets into a flow of working fluid moving through the turbomachine, such as air entering the compressor of a gas turbine.

While the wash liquid is injected, electrical energy having the first polarity is applied 76 to the turbomachine. The electrical energy 38 may be a high voltage.

The applied electrical energy forms an electrical charge on a surface in the turbomachine surface that is exposed to the working fluid and downstream of the injection of the wash liquid. The surface may be on the blades, e.g., rotor or stator blades, of the first stage of a compressor. The surface may also be the walls of a bell mouth casing at the inlet of the compressor.

The charged walls of the compressor and bell mouth casing repel the charged droplets, in step 78. The repulsion pushes droplets away from the walls and out of the slower air streams moving along the walls. Thus, the density is reduced of the droplets in the slower moving stream.

The surface charges on the blades are strongest on clean surfaces of the blades due to the exposed conductive metal that readily supports surface charges. Due to the repulsive force formed by the same charges, the charged droplets are repelled by the clean surfaces of the blades. The electrical surface charge will be relatively weak on dirty covered blade surfaces as dirt tends to be insulating and will diminish the electrical charge. The diminished surface charge on the dirty blade surfaces is less prone to repel wash droplets than the clean blade surfaces.

As it is cleaned, the surface has a greater surface charge and repels the wash droplets in step 80. The surface charge automatically increases as the surface is cleaned and the surface charge repels water droplets. The increased surface charge and repulsion of droplets reduces the risk of pitting and erosion on the blade.

The charge control system 34 may adjust the electrical charges on the wash liquid and the walls of the bell mouth casing and compressor, in step 82. The charge control system may monitor the charge on the bell mouth casing or compressor by sensing an electrical characteristic such as the resistance, impedance, voltage loss or current flow through the bell mouth housing or compressor.

For example, an increase in current flow may indicate higher levels of surface charges, e.g. eddy currents, on the surfaces of the compressor and thus a relatively clean compressor. The charge control system may monitor the current flow through the compressor and turn on the wash system if the current flow cross and drops below a first threshold current level.

While the wash system is turned on and water is injected into the compressor, the charge control system monitors the current flow through the compressor to determine when the current flow increases and crosses a second threshold current level, which is greater than the first threshold current level. In response to a crossing of the second threshold the charge control system turns off the wash system. Accordingly, the wash system may be controlled based on monitoring an electrical characteristic, e.g., current flow, in the compressor.

The wash system may provide advantages over conventional wash systems such as reduced risk of damage to blades, particularly to the roots of blades, due to erosion and pitting from the wash liquid. The wash system should be relatively simple and cost effective to install on new and existing gas turbines and other turbomachines. The pressure needed for the EHD nozzles is relatively low as compared to the water pressure needed for conventional nozzles.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A wash system for a compressor section in a turbomachine comprising: at least one nozzle assembly including a flow passage for a wash liquid, wherein the flow passage is configured to be coupled to a source of a wash liquid and includes a discharge outlet arranged to project the wash liquid into a stream of working fluid that flows into the compressor section of the turbomachine through an inlet; at least one electrode proximate to the flow passage of the nozzle assembly, wherein the at least one electrode is configured to form an electrical field sufficient to charge the wash liquid flowing through the flow passage and the charge applied to the wash liquid is of a first polarity, and at least one surface of the compressor section of the turbomachine charged with the first polarity, wherein the surface is exposed to the stream of working fluid and downstream of the at least one nozzle assembly; and a controller configured to monitor conductivity of the at least one surface and regulate an amount of wash liquid discharged from the at least one nozzle based on the monitored conductivity; wherein the at least one nozzle assembly includes an electrohydrodynamic nozzle and the at least one electrode includes an electrode tube forming the flow passage.

2. The wash system of claim 1 wherein the turbomachine is a gas turbine and the surface is a surface of compressor blades associated with a first stage of the compressor section.

3. The wash system of claim 2 wherein the at least one nozzle assembly is arranged on a wall of a bell mouth casing adjacent to the inlet to the compressor section, and the at least one nozzle assembly includes an array of nozzles arranged symmetrically around the wall of the bell mouth casing.

4. The wash system of claim 3 wherein the wall of the bell mouth has a surface electrical charge having the first polarity.

5. The wash system of claim 1 further comprising a charge control system electrically coupled to the at least one electrode and configured to control electrical energy to the at least one electrode.

6. The wash system of claim 1 further comprising:

a charge control system;

a wash control system; and a conductivity sensor;

wherein:

the charge control system is electrically coupled to the at least one electrode and configured to control electrical energy provided to the at least one electrode;

the conductivity sensor is configured to measure conductivity of the charged surface within the compressor section; and the wash control system is configured to receive and interpret information from the charge control system and the conductivity sensor and to regulate the wash liquid supplied to the at least one nozzle assembly based on the received information.

7. The wash system according to claim 1, wherein the conductivity is correlated to cleanliness of the surface.

8. The wash system according to claim 7, wherein a water flow rate is controlled based on surface cleanliness.

9. The wash system according to claim 7, wherein a time of water wash is controlled based on surface cleanliness.

* * * * *